US007337743B2

(12) United States Patent
Sydnor et al.

(10) Patent No.: US 7,337,743 B2
(45) Date of Patent: Mar. 4, 2008

(54) HIGH LIFT AUTHORITY MARINE CONTROL SYSTEM

(75) Inventors: Bryan J. Sydnor, Garden Grove, CA (US); David L. Hinch, Anaheim, CA (US); Wendell S. Nagao, Orange, CA (US)

(73) Assignee: The Boeing Company, Chicago, IL (US)

( * ) Notice: Subject to any disclaimer, the term of this patent is extended or adjusted under 35 U.S.C. 154(b) by 120 days.

(21) Appl. No.: 11/313,051

(22) Filed: Dec. 20, 2005

(65) Prior Publication Data

US 2007/0137549 A1 Jun. 21, 2007

(51) Int. Cl.
*B63B 1/00* (2006.01)
*F42B 19/01* (2006.01)

(52) U.S. Cl. ..... 114/271; 114/23; 244/3.24

(58) Field of Classification Search ..... 114/23, 114/330; 244/3.21, 3.24, 3.25, 3.26, 3.27
See application file for complete search history.

(56) References Cited

U.S. PATENT DOCUMENTS 2,899,899 A * 8/1959 Hirsch ..... 244/3.24
3,093,075 A * 6/1963 Garrett et al. ..... 244/3.24
5,551,365 A * 9/1996 Cipolla et al. ..... 114/23

OTHER PUBLICATIONS

Downloaded from http:www.wingsails.com/cetiri.html on Feb. 22, 2006.
Downloaded from http:www.cookoassociates.com/wingsails html on Feb. 22, 2006.
Downloaded from http:www geocites.com/CptinRn/wingsail.zefyr. jpg on Feb. 22, 2006.

* cited by examiner

*Primary Examiner*—Jesús D Sotelo
(74) *Attorney, Agent, or Firm*—McNees Wallace & Nurick, LLC

(57) ABSTRACT

A control surface system for a marine vehicle is provided. The control surface system includes a control member having at least two control portions fixedly connected at a predetermined spacing from each other. The control portions each have opposed surfaces, with the control portions being rotatable about an axis.

33 Claims, 4 Drawing Sheets

HIGH LIFT AUTHORITY MARINE CONTROL SYSTEM

STATEMENT REGARDING FEDERALLY SPONSORED RESEARCH OR DEVELOPMENT

This invention was made with government support under Contract No. N00024-00-C-6103. The United States Government has certain rights to the invention.

FIELD OF THE INVENTION

The present invention is directed to a control member within a control surface system, and more particularly, is directed to a control member within a control surface system for use with a marine vehicle.

BACKGROUND OF THE INVENTION

Marine vehicles, such as boats or totally submergible vehicles, are usable to transport a payload and other purposes. Payloads can include articles secured within the marine vehicle, or articles outside the vehicle that are pulled behind the marine vehicle, such as pulling a scuba diver through the water with reduced physical exertion. Irrespective of the type of marine vehicle and intended use, the ability to quickly and accurately control the direction of travel of the marine vehicle is extremely important.

It is known to use control members having control surfaces that extend outwardly from the marine vehicle in contact with the water to achieve directional control. By manipulating, e.g., rotating, the control member(s) with respect to the marine vehicle, the flow of water around the control surfaces produces "lift." To enhance directional control, the size of the control surfaces can be increased, which likewise increases the amount of lift produced by the control surfaces. However, larger control surfaces complicate handling of the marine vehicle by significantly increasing the cross-sectional profile of the marine vehicle. In the case of a control member extending downwardly from the hull of a boat, the minimum depth required to avoid damaging the control member from "bottoming out" is increased.

What is needed is a control member within a control surface system that produces increased control surface lift without appreciably increasing the cross-sectional profile of the marine vehicle.

SUMMARY OF THE INVENTION

The present invention relates to a control member within a control surface system for a marine vehicle including one or more control members, at least one of the one or more control members having at least two control portions fixedly connected at a predetermined parallel spacing. The at least two control portions each have opposed symmetrical surfaces about a plane bifurcating each of the control portions. Each of the control portions are rotatable about an axis parallel to the planes, and each of the control portions are configured for guiding the marine vehicle.

The present invention further relates to a control member for a marine vehicle including a control member. The control member has at least two control portions fixedly connected at a predetermined spacing, the at least two control portions each having opposed surfaces. The at least two control portions are rotatable about an axis.

The present invention still further relates to a control member within a control surface system for a vehicle including at least one control member. One or more of the at least one control member has at least two control portions fixedly connected at a predetermined spacing. The at least two control portions each have opposed surfaces, the at least two control portions being rotatable about an axis. Each of the at least two control portions are configured for guiding the vehicle.

The present invention yet still further relates to a method of constructing a control member within a control surface system for a vehicle. The steps of the method includes providing a plurality of control portions for guiding a vehicle. The method further includes fixedly connecting at least two control portions at a predetermined spacing to form a control member, the control member being rotatable about an axis.

An advantage of the present invention is that it appreciably increases lift produced by control members without appreciably increasing the cross-sectional profile of the marine vehicle. Increased lift makes the vehicle more maneuverable.

A further advantage of the present invention is that the marine vehicle is more easily transported.

A further advantage of the present invention is that the marine vehicle is less susceptible to damage.

Other features and advantages of the present invention will be apparent from the following more detailed description of the preferred embodiment, taken in conjunction with the accompanying drawings which illustrate, by way of example, the principles of the invention.

Wherever possible, the same reference numbers will be used throughout the drawings to refer to the same or like parts. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION OF THE INVENTION

Figure 1:
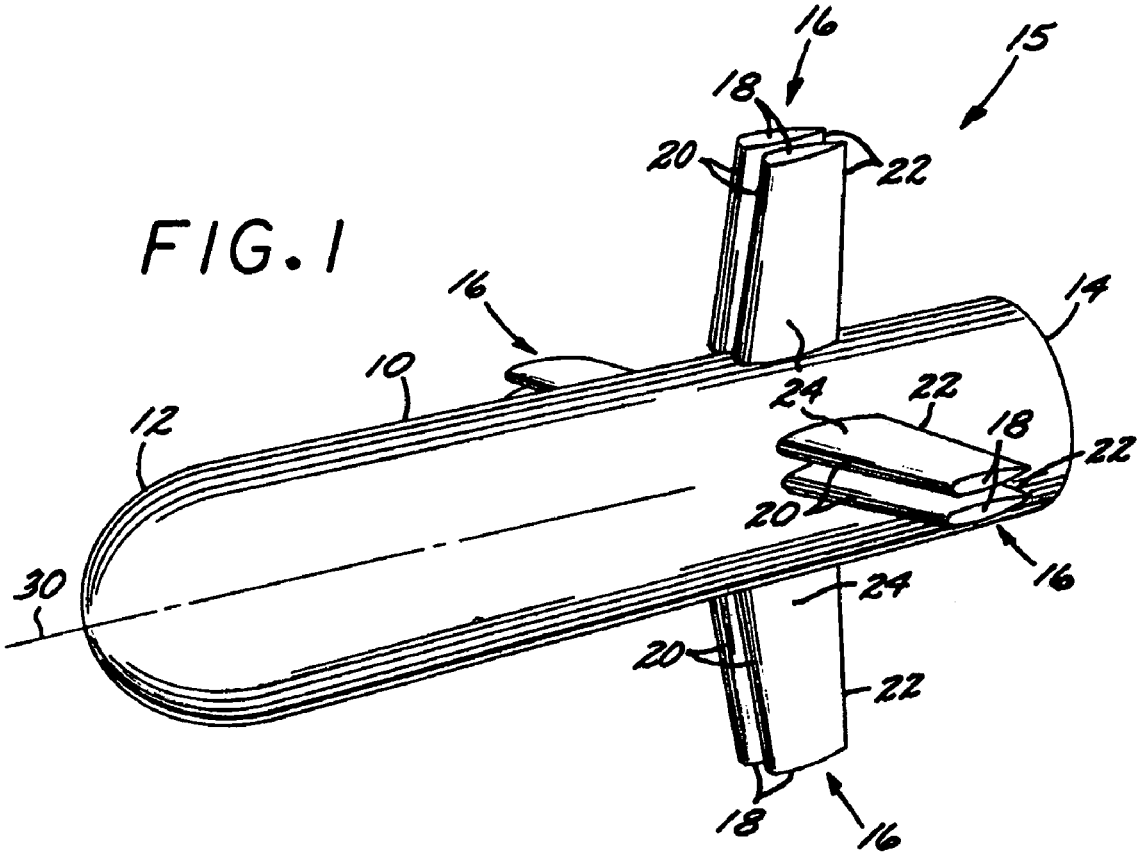
FIG. 1 is a perspective view of a marine vehicle including a control surface system of the present invention.
Figure 4:
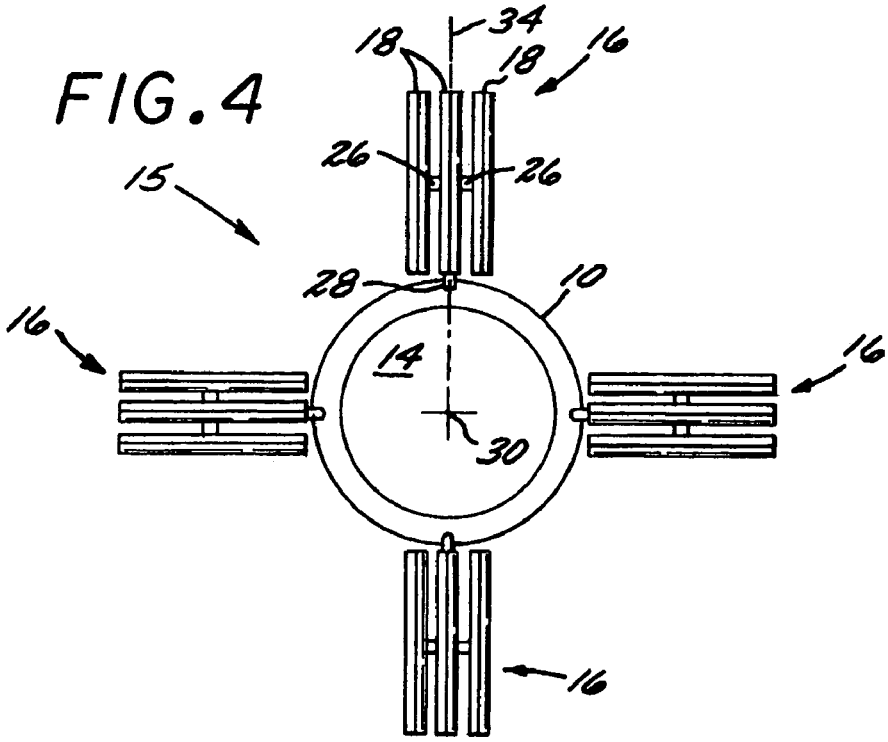
FIGS. 4-5 are end views of embodiments of a marine vehicle including a control surface system of the present invention.

FIG. 1 illustrates one embodiment of a control member 16 in a marine vehicle 10. As shown, marine vehicle 10 is totally submergible, such as for pulling a scuba diver (not shown), although a marine vehicle can also include a partially submergible vehicle, such as a boat in which control members 16 outwardly extend from the submerged portion of a hull (not shown). Marine vehicle 10 includes a bow 12 and stern 14, preferably including a plurality of control members 16, collectively comprising a control surface system 15, extending outwardly from the marine vehicle 10 in fluid communication with the water surrounding the marine vehicle 10. It is preferable that the marine vehicle 10 is substantially cylindrical and that the control members extend radially outward from a center of rotation 30 of the preferably cylindrically shaped marine vehicle 10. Preferably, control members 16 are disposed in opposed pairs, i.e., disposed 180 degrees from each other, such as when the total number of control members 16 is even. It is also preferable that the control member 16 pairs are equidistantly disposed about the center of rotation 30. For example, as shown in FIG. 4, each control member 16 is disposed 90 degrees from the adjacent control member 16. Each control member 16 comprises a pair of control portions 18 preferably having a leading edge 20, a trailing edge 22 and a control surface 24. The control portions 18 associated with each control member 16 actuate in unison as will be discussed in more detail below to achieve enhanced handling characteristics of the marine vehicle 10 without appreciably increasing the cross-sectional area of the marine vehicle 10.

For each of the control surface systems shown, the propulsion systems are not shown, as propulsion systems are well known, so as not to complicate the invention.

Figure 2:
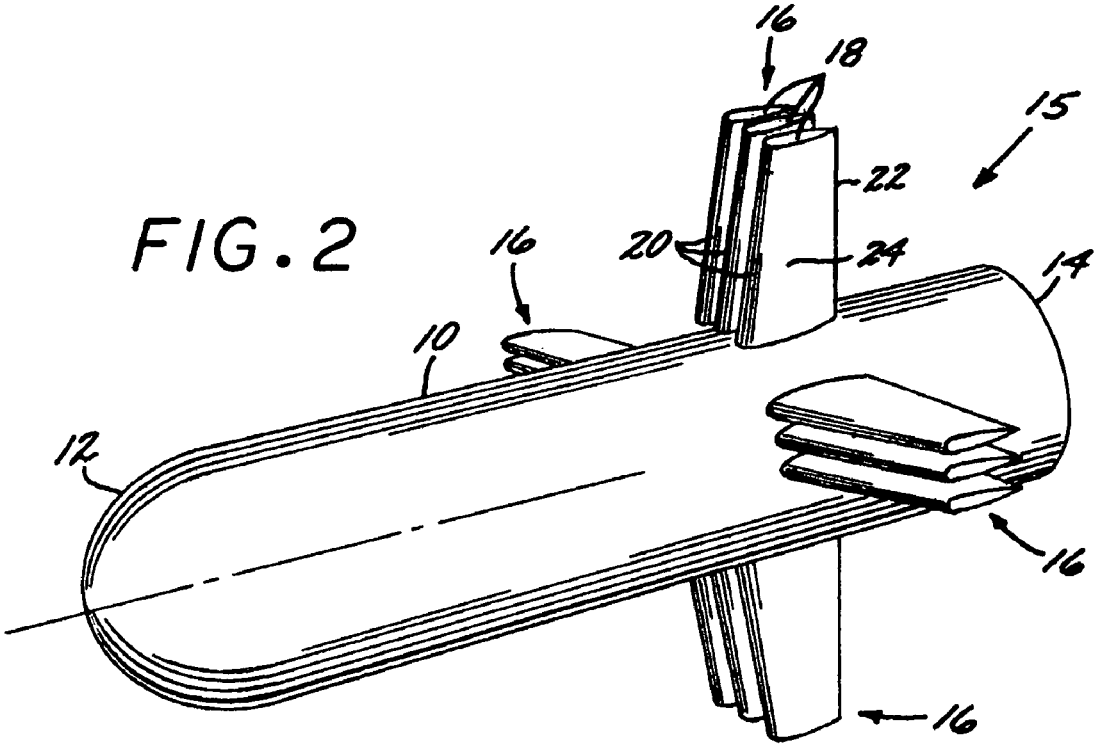
FIGS. 2 and 3 are perspective views of a marine vehicle including alternate embodiments of a control surface system of the present invention.
Figure 3:
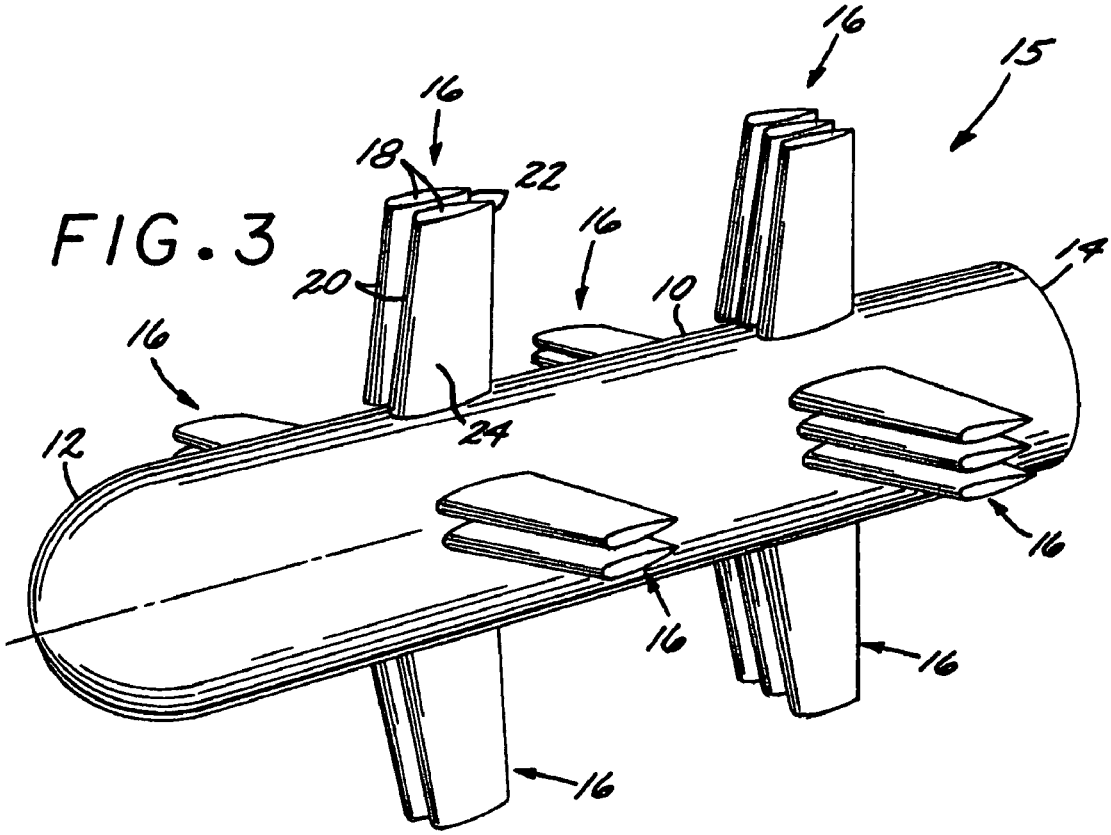
Figure 10:
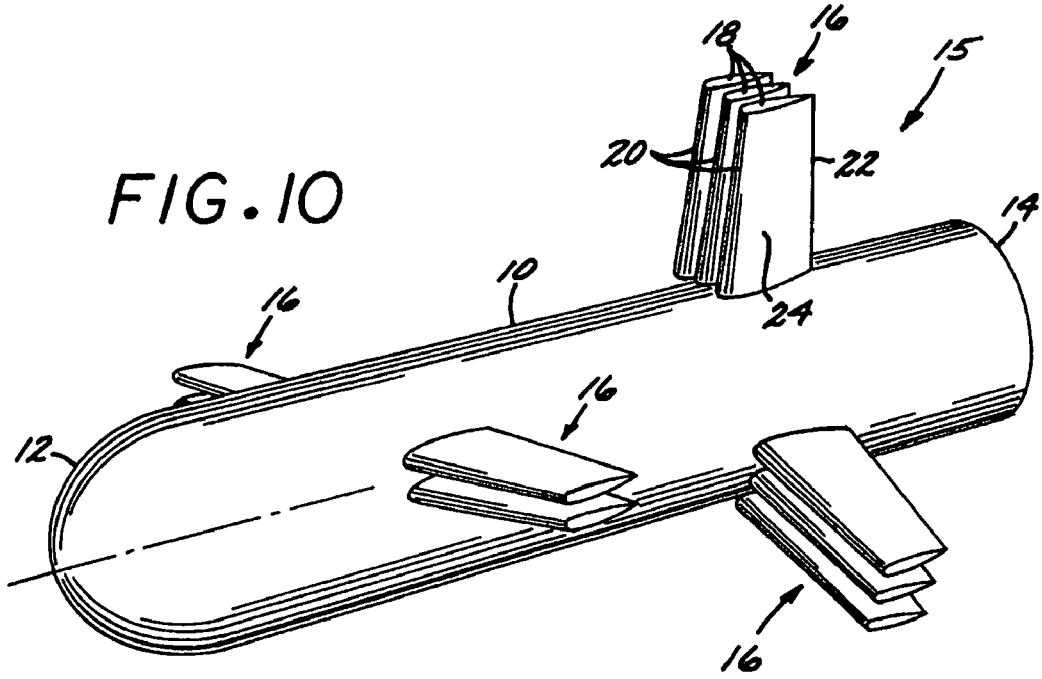
FIG. 10 is a perspective view of a marine vehicle including an alternate embodiment of a control surface system of the present invention.

Referring to FIG. 2, which is otherwise the same as FIG. 1, each control member 16 includes three control portions 18 that move in unison to guide the marine vehicle 10. Further, as shown in FIG. 3, the control members 16 can be disposed along the marine vehicle 10 anywhere between the bow 12 and stern 14, and multiple groupings of control members 16 can be substantially aligned longitudinally (FIG. 3). That is, from an end view of the marine vehicle 10 looking from the stern 14 toward the bow 12, similar to FIG. 4 which shows control members 16 disposed in the 3 o'clock, 6 o'clock, 9 o'clock and 12 o'clock positions, additional control members 16 can also be disposed in the 3 o'clock, 6 o'clock, 9 o'clock and 12 o'clock positions. Similarly, where the control member 16 can be disposed at other positions, such as the 1:30 o'clock, 4:30 o'clock, 7:30 o'clock and 10:30 o'clock positions, additional control members 16 can also be disposed in the 1:30 o'clock, 4:30 o'clock, 7:30 o'clock and 10:30 o'clock positions. Alternately, as shown in FIG. 10, at least one control member 16, and even each control member 16 if desired, can be disposed at a different position between the bow 12 and stem 14. Therefore, it is to be understood that the control members 16 of the present invention can be disposed at any positions along the surface of the marine vehicle, limited only by the desired handling characteristics of the marine vehicle. It is also to be understood that the number of control portions 18 can vary for each control member 16, and can include only one control portion 18 if desired.

Figure 5:
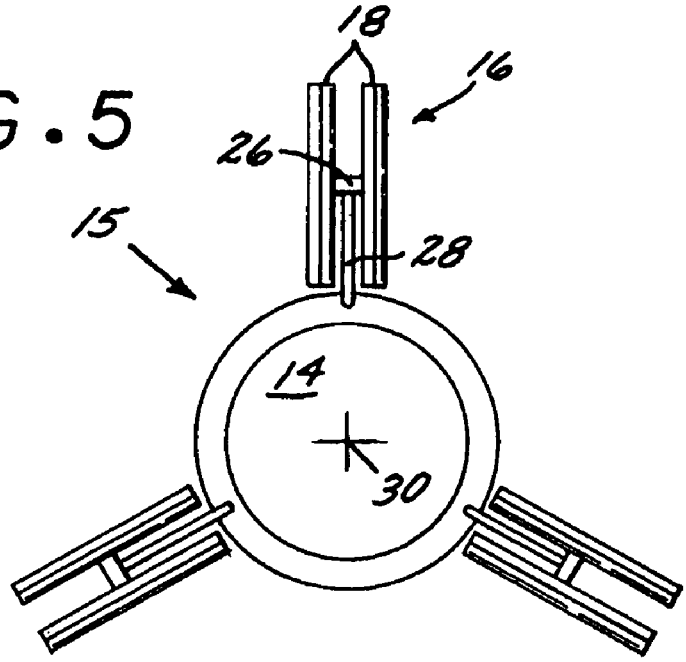

Referring to FIGS. 4 and 5, which show end views of the marine vehicle 10 looking from the stern 14 toward the bow 12 of the marine vehicle 10, preferably the control members 16 extend radially outward from the center of rotation 30 of the marine vehicle 10, and are symmetrically disposed and/or equally spaced about the center of rotation 30 as previously discussed. That is, a connection 28 rotatably secures the control member 16 to marine vehicle 10 about an axis 34 which is radially aligned with the center of rotation 30 of the marine vehicle 10. It is to be understood that control members 16 can be asymmetrically disposed and/or unequally spaced about the center of rotation 30 as previously discussed. However, it is to be understood that axis 34 is not required to be in radial alignment with the center of rotation 30.

Referring to FIGS. 6-9, control portions 18 of control member 16 are fixedly secured to each other by a support 26 or supports as desired. Stated another way, support 26 can include a single member that connects two or more control portions 18, although more than one support 26 can be used to connect two or more control portions 18. Although shown in FIGS. 8 and 9 as connecting the middle regions of adjacent control portions 18, support 26 can be located at any desired region or regions of adjacent control portions 18, including either or both ends. Additionally, a control member 16 can have a unitary construction, i.e., formed integrally from a single piece of material by a suitable method known in the art. Alternately, support 26 can include protrusions from the control surface 24 of a control portion 18 that is secured to an adjacent control portion 18 by suitable methods, including welding, adhesive or mechanical fasteners.

Figure 6:
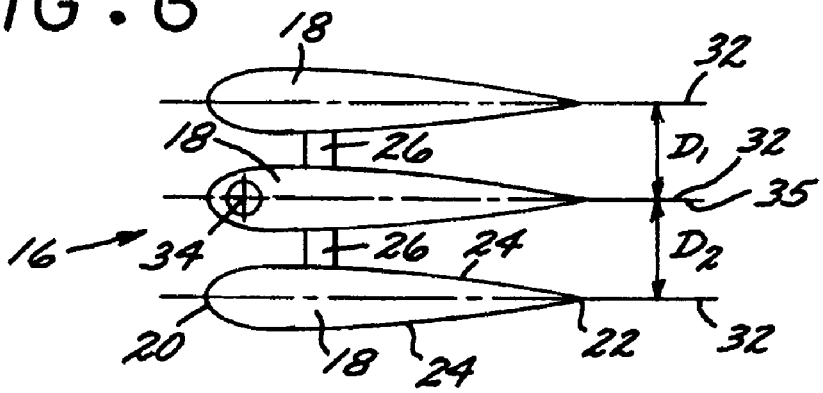
FIGS. 6 and 7 are end views of embodiments of control members of the present invention.

Support 26 fixedly connects adjacent control portions 18 of control member 16 together so that the control member 16 moves in unison, such as rotating about axis 34. In other words, the orientation and spacing of adjacent control portions 18 of control member 16 do not change with respect to each other as the control portions 18 rotate about axis 34. Preferably, control portions 18 are disposed parallel to each other. In one embodiment, each control portion 18 is symmetric about a plane of symmetry 32 extending through the leading edge 20 and trailing edge 22 of the control portion 18, which plane of symmetry 32 bisects the control portion 18. Additionally, it is preferable that the planes of symmetry 32 are parallel to each other. Referring again to FIG. 6, adjacent control portions 18 are separated by distances D1 and D2 as measured from respective planes of symmetry 32. Preferably, distances D1 and D2 are equal, although it is not necessary that D1 and D2 equal each other, depending upon the desired handling characteristics of the marine vehicle. Moreover, as shown in FIG. 6 for a control member 16 having an odd number of control portions 18, the axis of rotation 34 preferably is coincident with the plane of symmetry 32 of the middle control portion 18. Additionally, as shown in FIG. 6, the plane of symmetry 32 of the middle control portions 18 is a plane of symmetry 35 for the control member 16. One skilled in the art can appreciate that additional pair(s) of control portions 18 can be added to FIG. 6, wherein each additional control portion pair is equally spaced from the plane of symmetry 32 of control member 16.

Figure 7:
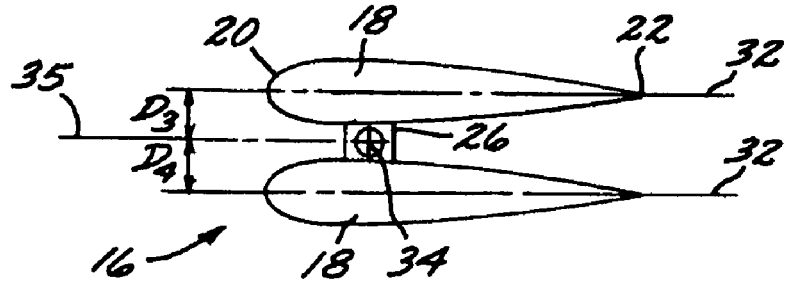
Figure 8:
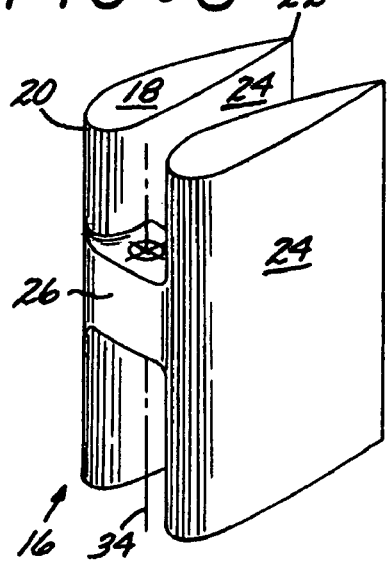
FIGS. 8 and 9 are perspective views of embodiments of control members of the present invention.
Figure 9:
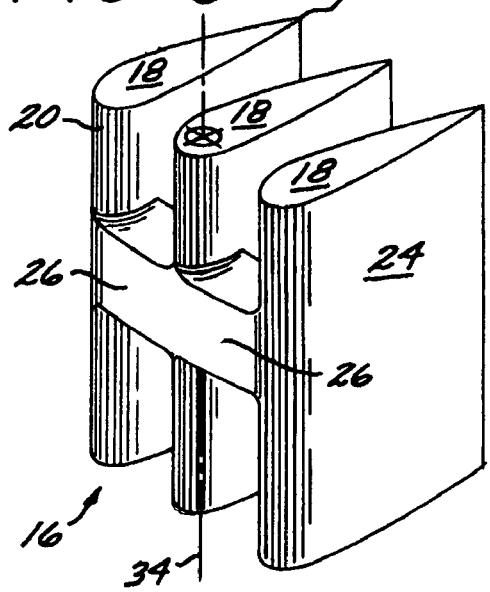

FIG. 7 shows a control member 16 having an even number of control portions 18. Preferably, the rotational axis 34 is disposed in support 26 connecting the adjacent control panels 18, wherein the axis 34 is parallel to and equidistant from the adjacent control panels 18. In other words, axis of rotation 34 is disposed at equal distances D3 and D4 from the planes of symmetry 32 of respective control portions 18. Further, as shown in FIG. 7, the axis of rotation 34 is coincident with a plane of symmetry 35 for the control member 16. One skilled in the art can appreciate that additional pair(s) of control portions 18 can be added to FIG. 7, wherein each additional control portion pair is equally spaced from the plane of symmetry 32.

In operation, a control surface system for a marine vehicle having the control member 16 provides enhanced handling capability by significantly increasing the lift associated with each control member 16. The increased lift is due to the increased amount of control surface area 24 associated with the additional control portions 18. For example, if a control member 16 having a single control portion 18 provided 10 pounds of lift under a predetermined set of operating conditions, such as those for pulling a scuba diver behind the marine vehicle, a control member 16 having two control portions 18 each of substantially equal size to the single control portion 18 would typically provide significantly more than 10 pounds of lift, such as about 14 pounds of lift, under substantially identical operating conditions. Similarly, as additional control portions 18 are added to the control member 16, the amount of lift produced by the control member 16 is further increased while only nominally increasing the cross-sectional profile of the marine vehicle.

It is to be understood that the size of the control portions of a control member can be similar, or not, and that if the size of the control portions is not similar, that the control portion(s) can be arranged in any order, based on the desired handling characteristics.

It is further to be understood that controls for the control surface system of the present invention can be configured to move the control members in unison, or opposite control members in unison or in opposition to each other. However, it is also understood that the control members can be controlled to move independently of each other. Moreover, it is to be understood that the control system can be disposed inside the vehicle or can be exterior of the vehicle.

Although the present invention has been described for use in water, one skilled in the art can appreciate that the present invention may also be used in other fluid or substantially fluid environments, such as other liquids, which can also include vapor.

It is also to be understood that although embodiments of marine vehicles are shown that are symmetric about an axis of symmetry, the control members 16 of the present invention can be used with marine vehicles that do not have an axis of symmetry.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A control member within a control surface system for a marine vehicle comprising:

one or more control members, at least one of the one or more control members having at least two control portions fixedly connected at a predetermined parallel spacing and having opposed unattached ends, the at least two control portions each having opposed symmetrical surfaces about a plane bifurcating the at least two control portions;

the at least two control portions being rotatable about an axis parallel to the planes; and wherein each of the at least two control portions are configured for guiding the marine vehicle.

2. A control member for a marine vehicle comprising:

a control member, the control member having at least two control portions fixedly connected at a predetermined parallel spacing and having opposed unattached ends, the at least two control portions each having opposed surfaces; and wherein the at least two control portions being rotatable about an axis.

3. The control member of claim 2 wherein the control member is of unitary construction.

4. The control member of claim 2 wherein each of the at least two control portions are parallel about a plane bifurcating the at least two control portions.

5. The control member of claim 2 wherein the opposed surfaces of at least one of the at least two control portions is symmetric about a plane bifurcating the at least one control portion.

6. The control member of claim 5 wherein the total number of the at least two control portions is an even number.

7. The control member of claim 6 wherein an axis of rotation for rotating the at least two central portions is equidistant from each of at least one pair of the at least two control portions.

8. The control member of claim 7 wherein the axis of rotation is coincident with a plane of symmetry for the control member.

9. The control member of claim 5 wherein the total number of the control portions is an odd number greater than two.

10. The control member of claim 9 wherein an axis of rotation for rotating the at least two control portions is coincident with a bifurcating plane of one of the at least two control portions.

11. The control member of claim 10 wherein the axis of rotation is coincident with a plane of symmetry for the control member.

12. The control member of claim 2 wherein at least two of the at least two control portions are parallel about a plane bifurcating the at least two control portions.

13. A control member within a control surface system for a vehicle comprising:

at least one control member, one or more of the at least one control member having at least two control portions fixedly connected at a predetermined parallel spacing, the at least two control portions each having opposed surfaces and opposed unattached ends;

the at least two control portions being rotatable about an axis; and wherein each of the at least two control portions are configured for guiding the vehicle.

14. The control member of claim 13 wherein the control member is of unitary construction.

15. The control member of claim 13 wherein each of the at least two control portions are parallel about a plane bifurcating the at least two control portions.

16. The control member of claim 13 wherein at least one of at least two control members has a different total number of control portions.

17. The control member of claim 13 wherein at least one of the at least one control members extend radially outward from a periphery of the vehicle.

18. The control member of claim 13 wherein at least two control members are symmetrically disposed about a periphery of the vehicle.

19. The control member of claim 13 wherein the at least one control members are asymmetrically disposed about a periphery of the vehicle.

20. The control member of claim 13 wherein at least two control members are equally angularly spaced.

21. The control member of claim 13 wherein the at least one control member is positionable anywhere between a bow and a stern of the vehicle.

22. The control member of claim 13 wherein at least two control members are controlled to move in unison.

23. The control member of claim 13 wherein opposed control members of at least two control members are controlled to move in unison or in opposition.

24. The control member of claim 13 wherein at least one of at least two control members is independently controlled.

25. The control member of claim 13 wherein the opposed surfaces of at least one of the at least two control portions is symmetric about a plane bifurcating the at least one control portion.

26. The control member of claim 25 wherein the total number of the at least two control portions is an even number.

27. The control member of claim 26 wherein an axis of rotation for rotating the at least two control portions is equidistant from each of at least one pair of the at least two control portions.

28. The control member of claim 27 wherein the axis of rotation is coincident with a plane of symmetry for the control member.

29. The control member of claim 25 wherein the total number of the control portions is an odd number greater than two.

30. The control member of claim 29 wherein an axis of rotation for rotating the at least two control portions is coincident with a bifurcating plane of one of the at least two control portions.

31. The control member of claim 30 wherein the axis of rotation is coincident with a plane of symmetry for the control member.

32. The control member of claim 13 wherein at least two of the at least two control portions are parallel about a plane bifurcating the at least two control portions.

33. A method of constructing a control member within a control surface system for a vehicle, the steps comprising:

providing a plurality of control portions for guiding a vehicle; and fixedly connecting at least two control portions having opposed unattached ends at a predetermined parallel spacing to form a control member, the control member being rotatable about an axis.

* * * * *

UNITED STATES PATENT AND TRADEMARK OFFICE

CERTIFICATE OF CORRECTION

PATENT NO. : 7,337,743 B2
APPLICATION NO. : 11/313051
DATED : March 4, 2008
INVENTOR(S) : Bryan J. Sydnor It is certified that error appears in the above-identified patent and that said Letters Patent is hereby corrected as shown below:

Title Page; item (56); col. 2;
Reference Section: "www.cookoassociates.com" should be
--www.cookeassociates.com--
Col. 4, Line 47: "portions 18" should be --portion 18--
Col. 6, Line 22: "central" should be --control--

Signed and Sealed this

Seventh Day of July, 2009

JOHN DOLL
*Acting Director of the United States Patent and Trademark Office*